US011620891B2

(12) United States Patent
Heinonen

(10) Patent No.: US 11,620,891 B2
(45) Date of Patent: Apr. 4, 2023

(54) METHOD AND SYSTEM FOR DETERMINING AREA OF FIRE AND ESTIMATING PROGRESSION OF FIRE

(71) Applicant: Ai4 International Oy, Helsinki (FI)

(72) Inventor: Tero Heinonen, San Francisco, CA (US)

(73) Assignee: Ai4 International Oy, Helsinki (FI)

( * ) Notice: Subject to any disclaimer, the term of this patent is extended or adjusted under 35 U.S.C. 154(b) by 59 days.

(21) Appl. No.: 17/066,710

(22) Filed: Oct. 9, 2020

(65) Prior Publication Data

US 2021/0110691 A1 Apr. 15, 2021

Related U.S. Application Data

(60) Provisional application No. 62/913,309, filed on Oct. 10, 2019.

(51) Int. Cl.
*G08B 17/00* (2006.01)

(52) U.S. Cl.
CPC ..... *G08B 17/005* (2013.01)

(58) Field of Classification Search
CPC .... G08B 17/005; G08B 29/188; G08B 31/00; A62C 3/0271; A62C 3/02
See application file for complete search history.

(56) References Cited

U.S. PATENT DOCUMENTS

2016/0313120 A1* 10/2016 Shishalov ..... H04N 5/23206
2018/0374330 A1* 12/2018 Balaji ..... G08B 29/145
2020/0159397 A1* 5/2020 Tohidi ..... G06F 3/04847

* cited by examiner

*Primary Examiner* — Andrew W Bee
(74) *Attorney, Agent, or Firm* — Ziegler IP Law Group LLC

(57) ABSTRACT

Disclosed is a method and system for determining an area of fire and a method and system for estimating progression of a fire in the determined area of fire. The method for determining the area of fire comprises receiving sensor data from a plurality of sensor modules and determining the area of fire based on relative locations of the sensor modules with respect to each other. The method for estimating progression of a fire comprises receiving first and second sensor data from at least one sensor module and devising a plurality of fire scenarios for each of the sensor data. The method further comprises determining a likelihood of each of the plurality of fire scenarios to identify a potential combination of fire scenarios to estimate the progression of the fire.

5 Claims, 4 Drawing Sheets

METHOD AND SYSTEM FOR DETERMINING AREA OF FIRE AND ESTIMATING PROGRESSION OF FIRE

TECHNICAL FIELD

The present disclosure relates generally to fire detection; and more specifically, to methods and system for determining area of fire. Moreover, the present disclosure also relates to methods and systems for estimating progression of a fire.

BACKGROUND

In recent years, several forest areas have been cleared for establishing human colonies. Such human colonies have led to establishment of densely populated urban interfaces near forests. Moreover, densely populated urban interfaces have been established near areas with natural dense assortments of flammable materials. It will be appreciated that such flammable areas (such as, forests and areas with flammable materials) are often prone to wildfires. Subsequently, flammable areas pose great danger of fire to densely populated urban interfaces established in close vicinity of them. For example, the forest in California often pose a threat to their nearby establishments.

Conventionally, satellites and airborne imaging devices are employed to identify early stage of fire in flammable areas to alert people in vicinity thereof. Notably, such devices easily detect the fires in the forests using fire indicators such as smoke plumes. However, identification of fire in urban interfaces based on smoke plumes is not efficient owing to presence of smoke plumes due to, for example, outdoor grills, fireplaces, outdoor leaf burns, smoke from industries, smoke from vehicles, air pollutants, and so forth, that are fire indicators but don't pose any threat. Subsequently, such devices cannot efficiently identify a fire by distinguishing between critical event of fire and fire due to aforesaid elements. Consequently, the conventional devices raise a false fire alarm for fire outbreaks in human colonies based on such fire indicators.

Furthermore, conventional methods of fire detection are only effective for identification of a fire in an area. Notably, estimation of parameters relating to fire and formulation of firefighting strategies are still largely dependent on human expertise and manual trials-and-errors. In recent times, fire prediction models have been developed that allow estimation of different parameters (namely, characteristics) of the fire. However, such fire prediction models are time-intensive and inefficient. It will be appreciated that in order to effectively control a fire, different firefighting strategies may need to be tested to identify an optimized way of controlling the fire. However, the fire prediction models known in the art are physics-based fire models that take several hours to evaluate conditions of a small area of land. Such time-intensive approach to fire prediction and modelling makes testing of several possible scenarios relating to the fire impractical. Furthermore, conventional fire prediction models require large amounts of data to model the fires correctly. However, such quantities of data are generally not available and therefore, often fire modelling by conventional fire prediction models is not accurate.

The conventional methods do not enable to estimate and predict characteristics of fire (such as the perimeter) combining various sensor data such as cameras (e.g. such as dedicated wildfire cameras, surveillance cameras, doorbell cameras, smartphone cameras (cameras including still, video, etc); smoke sensors including dedicated wildfire sensors, air quality monitor sensors and stations; satellite imaging: including geostationary satellites (pixel size coarse 1-2 km, which provide data at a few minute level), low-earth-orbit satellites (which provide down to centimetres pixel size data, but with revisit times (time of imaging the same location) several hours or a few days. If these sources could be integrated, wildfire detection would be faster, more reliable, cause less wrong alerts. The conventional methods do not enable to predict the fire progression based on the characteristics of fire as determined by the above-mentioned methods. Thus, if wildfire prediction would be based on all available data, the accuracy and precision of the predictions could be improved. The conventional fire prediction models are also too slow to calculate and the responding agencies would need to be able to test a combination of what-if-scenarios, such as if the wind speed in location A increase, and the wind direction in location B changes, what will happen. These what-if scenarios are required in a high-pressure operative situations, where decisions need to be made to save lives but by the conventional models it takes too much time and make what if-testing difficult. Physics based fire (similar to weather models based on e.g. fluid dynamics) models take several hours to evaluate for a small area such as 20 km×20 km, making what if-testing impossible. The conventional fire prediction models also lack critical input data. The prior art fire prediction models often require a lot of data which is not available. These are typically estimated, which leads to bad quality of forecasts. If these parameters could be derived from actual sensor data, the models and predictions would be more accurate. For example, a typical parameter is object (or biomass) surface area (as in m2) per object volume (as in m3), which explains how much burning and igniting surface there is per amount of fuel. Typically, this is an estimated constant for an area. Instead, sensor data such as LiDAR can provide actual, localized, precise information of this quantity, which is not based on estimation but actual measurement from a point cloud of both area and volumes.

Therefore, in light of the foregoing discussion, there exists a need to overcome the drawbacks associated with conventional methods for fire detection and prediction the fire progression.

SUMMARY

The present disclosure seeks to provide a method for determining an area of fire. The present disclosure also seeks to provide a system for determining an area of fire. An aim of the present disclosure is to provide a solution that overcomes at least partially the problems encountered in prior art.

In first aspect, the present disclosure provides a method for determining an area of fire, the method comprising: arranging a first sensor module, a second sensor module and a third sensor module on an observation area at different locations from each other; receiving sensor data from each of the sensor modules; determining relative location of each of the sensor modules with each other in respect to wind; and determining the area of fire to be within an area defined by the locations of the sensor modules if: the first sensor module detects fire while the second sensor module and the third sensor module do not detect fire; and the second sensor module and the third sensor module are windward from the first sensor module.

In second aspect, the present disclosure provides a system for determining an area of fire, the system comprising: a first sensor module, a second sensor module, and a third sensor module arranged on an observation area, wherein the sensor modules are arranged at different locations from each other; and a server arrangement communicably coupled to the sensor modules, wherein the server arrangement: receives sensor data from each of the sensor modules; determines relative location of each of the sensor modules with each other in respect to wind; and determines the area of fire to be within an area defined by the locations of the sensor modules if: the first sensor module detects fire while the second sensor module and the third sensor module do not detect fire; and the second sensor module and the third sensor module are windward from the first sensor module.

In third aspect, the present disclosure provides a method for estimating progression of a fire, the method comprising: receiving first sensor data at a first time instance from at least one sensor module; receiving second sensor data at a second time instance from the at least one sensor module; devising a plurality of first fire scenarios for the first time instance; devising a plurality of second fire scenarios for the second time instance; determining a likelihood of each of the plurality of first fire scenarios matching the first sensor data; determining a likelihood of each of the plurality of second fire scenarios matching the second sensor data; determining a likelihood of fire progression from a given first fire scenario to a given second fire scenario over a time period between the first time instance and the second time instance; determining combined likelihoods of a plurality of combinations of fire scenarios, wherein each combination of fire scenarios comprises a first fire scenario and a second fire scenario and wherein the combined likelihood for a given combination of first fire scenario and second fire scenario is determined based on the likelihood of the first fire scenario in the combination matching the first sensor data, the likelihood of the second fire scenario in the combination matching the second sensor data, and the likelihood of fire progression from the first fire scenario to the second fire scenario; identifying at least one potential combination of first fire scenario and second fire scenario with a combined likelihood higher than a predefined threshold; and estimating progression of the fire and area of the fire based on the at least one potential combination of first fire scenario and second fire scenario.

In fourth aspect, the present disclosure provides a system for estimating progression of a fire, the system comprising at least one sensor module arranged in an observation area; and a server arrangement communicably coupled to the at least one sensor module, the server arrangement configured to: receive first sensor data at a first time instance from at least one sensor module; receive second sensor data at a second time instance from the at least one sensor module; devise a plurality of first fire scenarios for the first time instance; devise a plurality of second fire scenarios for the second time instance; determine a likelihood of each of the plurality of first fire scenarios matching the first sensor data; determine a likelihood of each of the plurality of second fire scenarios matching the second sensor data; determine a likelihood of fire progression from a given first fire scenario to a given second fire scenario over a time period between the first time instance and the second time instance; determine combined likelihoods of a plurality of combinations of fire scenarios, wherein each combination of fire scenarios comprises a first fire scenario and a second fire scenario and wherein the combined likelihood for a given combination of first fire scenario and second fire scenario is determined based on the likelihood of the first fire scenario in the combination matching the first sensor data, the likelihood of the second fire scenario in the combination matching the second sensor data, and the likelihood of fire progression from the first fire scenario to the second fire scenario; identify at least one potential combination of first fire scenario and second fire scenario with a combined likelihood higher than a predefined threshold; and estimate progression of the fire and area of the fire based on the at least one potential combination of first fire scenario and second fire scenario.

Embodiments of the present disclosure substantially eliminate or at least partially address the aforementioned problems in the prior art, and enable reliable accurate and timely detection and prediction of fire, the area of fire and estimation the progression of a fire. For the detection, prediction and estimation the fire and fire progression the embodiments according to the present disclosure enable to integrate data from satellites aerial patrols, third party fixed and mobile sensors and cameras; data from public data sources comprising road, map, elevations, administrative, weather, structures, resources data; mobile and stationary sensors comprising multi-spectral, thermal, SAR, visual, LiDAR, fire, weather, camera, video, wind, humidity, smoke, CO, air pressure data with interfaces for operative systems, dispatching response management; field, commander and monitor services.

The embodiments of the present disclosure enable faster, more reliable wildfire detection and cause less wrong alerts. Therefore, the firefighting is less timely (to reduce the area and damage of fire) and better informed (to enable evacuations, and to improve responder safety). The embodiments of the present disclosure enable to predict the fire progression based on the characteristics of fire. Thus, the accuracy and precision of the predictions is improved. Therefore, the firefighting is better informed to make the firefighting more effective and efficient, to enable evacuations, and to improve responder safety.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers. Embodiments of the present disclosure will now be described, by way of example only, with reference to the following diagrams wherein.

DETAILED DESCRIPTION OF EMBODIMENTS

Figure 1:
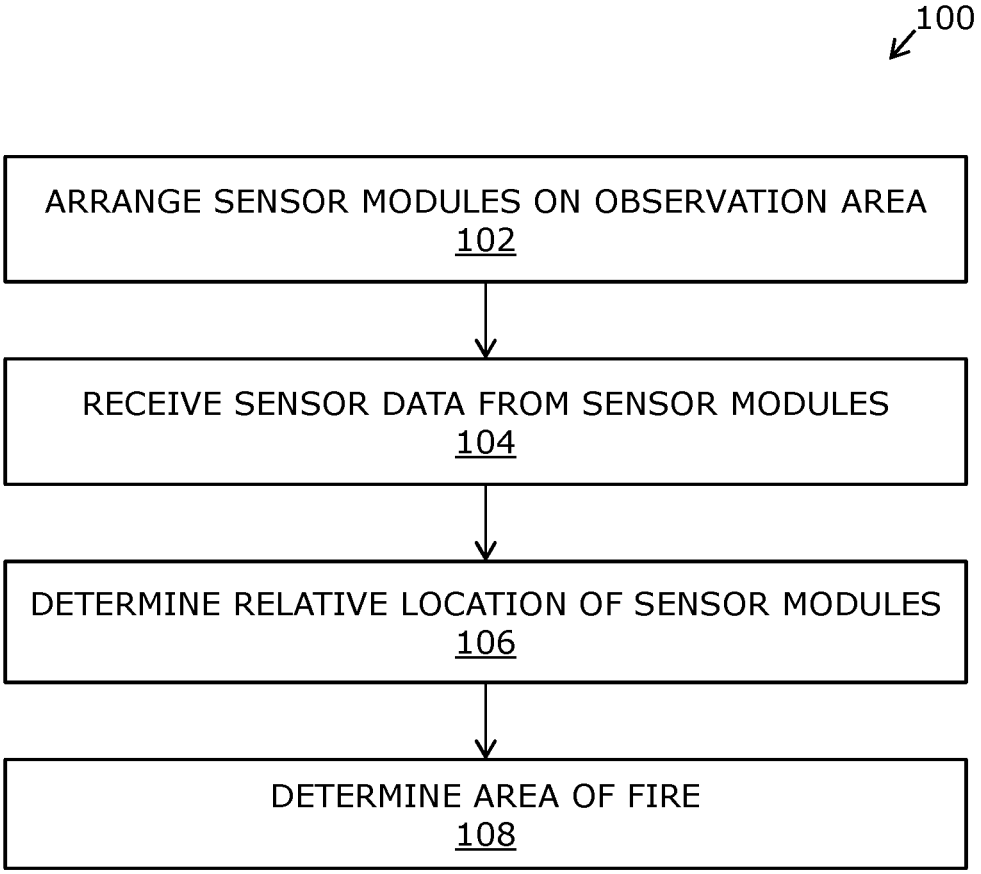
FIG. 1 is an illustration of steps of a method for determining an area of fire, in accordance with an embodiment of the present disclosure.

The following detailed description illustrates embodiments of the present disclosure and ways in which they can be implemented. Although some modes of carrying out the present disclosure have been disclosed, those skilled in the art would recognize that other embodiments for carrying out or practicing the present disclosure are also possible.

In one aspect, an embodiment of the present disclosure provides a method for determining an area of fire, the method comprising arranging a first sensor module, a second sensor module and a third sensor module on an observation area at different locations from each other; receiving sensor data from each of the sensor modules; determining relative location of each of the sensor modules with each other in respect to wind; and determining the area of fire to be within an area defined by the locations of the sensor modules if: the first sensor module detects fire while the second sensor module and the third sensor module do not detect fire; and the second sensor module and the third sensor module are windward from the first sensor module.

In another aspect, an embodiment of the present disclosure provides a system for determining an area of fire, the system comprising: a first sensor module, a second sensor module, and a third sensor module arranged on an observation area, wherein the sensor modules are arranged at different locations from each other; and a server arrangement communicably coupled to the sensor modules, wherein the server arrangement: receives sensor data from each of the sensor modules; determines relative location of each of the sensor modules with each other in respect to wind; and determines the area of fire to be within an area defined by the locations of the sensor modules if: the first sensor module detects fire while the second sensor module and the third sensor module do not detect fire; and the second sensor module and the third sensor module are windward from the first sensor module.

The present disclosure provides method and system to enable accurate detection of fire. Specifically, the method and system described in the present disclosure provides an economical and efficient method for identification of area of fire in urban interfaces. More specifically, the present disclosure discloses a ground-based sensor capability, fixed and/or mobile, that is affordable for dense deployment in area of urban interfaces. Beneficially, the system can detect and differentiate fire indicators (for example, smoke plumes) with sufficient granularity to reduce false positives to low level of fire that are caused due to for example, outdoor grills, fireplaces, vehicular exhaust, exhaust from factories, and burning leaves.

The accurate detection of the area of fire further enables to estimate progression of a fire in the determined area of fire. Thus, the present disclosure further provides a method and system for estimating progression of a fire in the determined area of fire.

The method for determining the area of fire is implemented using the server arrangement and the sensor modules. Notably, the method is implemented to identify area of fire, wherein the area of fire refers to a geographical area which is burning, for example a forest, an urban interface, and the like. Optionally, the method for determining the area of fire is implemented in an urban interface, wherein an urban interface is a densely populated settlement. It will be appreciated that the urban interface may be a town, a city, a suburb, a conurbation, and the like.

The method for determining the area of fire comprises arranging the first sensor module, the second sensor module and the third sensor module on the observation area at different locations from each other. It will be appreciated that the sensor modules (namely, the first sensor module, the second sensor module and the third sensor module) are deployed on the observation area, wherein the observation area is a target area where an event of fire is to be detected. In an instance, the sensor modules are fastened on fixed deployments (for example, houses, lamp posts, street lights, electric poles, utility poles, fences, gates, and the like) in the observation area. In another instance, the sensor modules are fastened on mobile deployments (for example, utility vehicles, package delivery vehicles, vending vehicles, and the like) that are routinely present in the observation area.

Pursuant to the present disclosure, a sensor module refers to an electronic device comprising at least one sensor configured to detect and/or respond to input from the observation area. Optionally, the sensor module includes components such as sensors, memory, processor, network adapter, battery, and the like, to detect, store, process and/or share information with other computational elements, such as a user device, the server arrangement (as discussed in detail later, herein). More optionally, the sensor modules operate autonomously to continuously detect input (namely, sensor data) from physical environment of the observation area.

Optionally, with respect to the system for determining an area of fire and for estimating progression of a fire in the determined area of fire, the sensor module comprises at least one of: fire detection sensor, location sensor, wind sensor, communication means, imaging device, detection sensor. In this regard, a fire detection sensor of a sensor module from the sensor modules enables identification of fire in the observation area by detecting level of smoke in the observation area. Moreover, a location sensor of the sensor module enables identification of a geographical location (namely, geolocation) of the sensor module thereby enabling identification of location coordinates of the observation area. The location sensor may be based on, for example, Global Navigation Satellite System (GNSS), Global Positioning System (GPS), and the like. Additionally, a wind sensor of the sensor module enables detection of direction of wind in the observation area. An imaging device enables remote viewing of the observation area. Optionally, the imaging device captures an image, for example, a 360-degree image, of the observation area. More, optionally, the imaging device may capture still image of the observation area and/or video of the observation area. Moreover, a detection sensor of the sensor module detects physical conditions of the observation area. The physical conditions may include, for example, humidity, air pressure, temperature, and level of organic volatile compounds in the observation area. Additionally, or optionally the detection sensors can be CO, $NO_2$, $O_3$, HCl, glutaraldehyde, and acrolein, ozone, arsenic or arsine sensors. The detection sensors can also be sensors configured to detect particulate matter, e.g. 1 μm (micrometre), 2.5 μm, and 10 μm size particles in the air. The detection sensor may further comprise motion detection sensor, air quality sensor or motion detection sensor and air quality sensor. Furthermore, a communication means enables the sensor module to communicate information (namely, sensor data) detected by sensors (namely, fire detection sensor, location sensor, wind sensor, imaging device, and detection sensor) to a computational device (for example, a user device, the server arrangement, and the like).

Moreover, sensor modules are strategically deployed on the observation area for effectively identifying the area of fire in the observation area. Specifically, sensor modules are positioned at different geolocations (specifically, geographical locations) in the observation area. In an example, an observation area in an urban interface may be a locality, a neighbourhood, a district, a street, an establishment, an institution, a premise, and the like.

Optionally, the observation area is defined by joining location coordinates of each of the sensor modules with a line, wherein the observation area is defined by the area covered by the sensor modules. It will be appreciated that an area defined by drawing a line between the sensor modules (namely, the first sensor module, the second sensor module and the third sensor module) forms an observation area for the sensor modules. In an example, the first sensor module, the second sensor module and the third sensor module form a triangular observation area.

Moreover, optionally, each of the sensor modules determines geolocation thereof by employing location sensor. Subsequently, the sensor modules communicate the determined geolocations to the server arrangement. Furthermore, the server arrangement determines a coverage area for each of the sensor modules, wherein a coverage area for a sensor module is a minimum area in which the sensor module can operate independently and efficiently. Beneficially, determining coverage area of each of the sensor modules enables planning of future arrangements (namely, deployments) of sensor modules in a strategic manner that minimizes cost by judiciously deploying the sensor modules at strategic locations.

The sensor modules are communicably coupled to the server arrangement. It will be appreciated that the server arrangement refers to a structure and/or a module that include programmable and/or non-programmable components configured to store, process and/or share information. Optionally, the server arrangement includes an arrangement of physical or virtual computational entities capable of enhancing information to perform various computational tasks. Furthermore, it will be appreciated that the server arrangement may be both single hardware server and/or plurality of hardware servers operating in a parallel or distributed architecture. In an example, the server arrangement may include components such as memory, a processor, a network adapter and the like, to store, process and/or share information with other computing components, such as a user device, the sensor modules, and the like. Optionally, the server arrangement is implemented as a computer program that provides various services (such as database service) to other devices, modules or apparatus.

The method comprises receiving sensor data from each of the sensor modules. In this regard, the sensor data from each of the sensor modules arranged on the observation area is received by the server arrangement. It will be appreciated that the sensor modules communicate the sensor data by employing communication means in the sensor modules and data communication network (for example, Internet). Optionally, the sensor modules communicate the sensor data periodically to the server arrangement. More optionally, the sensor modules communicate the sensor data periodically in, for example, every 10 seconds, every 30 seconds, every 1 minute, every 2 minutes, every 5 minutes, and so forth. It will be appreciated that the server arrangement may set a time period for periodic receiving of sensor data from the sensor modules.

Moreover, the method comprises determining relative location of each of the sensor modules with each other in respect to wind. In this regard, the server arrangement determines a geographical location (namely, geolocation) of each of the sensor modules with respect to each other; and further determines which sensor module from the sensor modules is windward with respect to each other.

In an example, geolocation associated with the sensor modules arranged on the observation area and direction of wind in the observation area are employed to determine relative location of each of the sensor modules with each other in respect to wind. Optionally, wind sensors in the sensor modules are employed to receive the direction of wind in geolocation associated with the sensor modules (namely, the observation area). Moreover, optionally, wind sensors may be distributed independently within the observation area and/or outside of the observation area. Alternatively, optionally, the server arrangement receives weather data (for example, wind speed, wind direction, temperature, humidity, visibility, pressure, precipitation, and the like) relating to the observation area from a weather service platform to determine the direction of wind in the observation area. Moreover, geolocation associated with each of the sensor modules and direction of wind in the observation area is received by the server arrangement to determine location of each of the sensor modules with respect to other sensor modules in the observation area and determine windward sensor module from each other.

Furthermore, the method comprises determining the area of fire to be within the area defined by the locations of the sensor modules if the first sensor module detects fire while the second sensor module and the third sensor module do not detect fire, and the second sensor module and the third sensor module is windward from the first sensor module. It will be appreciated that the area defined by the locations of the sensor modules (namely, the first sensor module, the second sensor module and the third sensor module) forms the observation area. Optionally, the area defined by the locations of the sensor modules comprise coverage area associated with each of the sensor modules. Moreover, the server arrangement determines the area of fire to be within the observation area based on sensor data provided by the sensor modules arranged on the observation area. In an instance, the area of fire is within a triangular observation area that is defined by joining the geolocation of the first sensor module, second sensor module and third sensor module, with a line.

It will be appreciated that the first sensor module detects fire as it is downward from wind. Moreover, the second sensor module and the third sensor module do not detect fire as they are windward from the first sensor module and/or the area of fire. Hence, the area of fire is determined to be within the area defined by locations of the sensor modules.

It will be appreciated that a sensor module detects abnormal sensor data (such as, high level of smoke, high temperature, high level of heat, high air pressure, low humidity, high level of organic volatile compound and images depicting flame) in an event of fire. Optionally, sensor data from the first sensor module, the second sensor module and the third sensor are collaboratively processed to determine the area of fire within the observation area, when abnormal sensor data is received from at least one of the sensor modules by the server arrangement. Beneficially, processing sensor data from each of the sensor modules enable identification of precise location of fire (namely, area of fire) thereby enabling quick response to tackle the event of fire.

Optionally, the method further comprises characterizing the area of fire, wherein the characterization is based on an intensity of fire in the determined area of fire. It will be appreciated that the intensity of fire is determined based on sensor data, for example, smoke, heat, temperature, and the like. Moreover, optionally, the server arrangement characterises the area of fire based on source thereof, wherein the source is identified by processing one or more images of the observation area communicated by the sensor modules. The server arrangement identifies source of fire in area of fire to be, for example, outdoor grills, burning garbage, bonfire, barbeque, wildfires, building, and the like. Subsequently, fire in the area of fire is classified as, for example, insignificant, minor, moderate and critical based on intensity of fire determined from sensor data and source of fire identified from sensor data, received from the sensor modules.

Additionally, optionally, the server arrangement determines auxiliary information associated with the area of fire in case of, for example, critical nature of fire in the area of fire. More optionally, auxiliary information associated with the area of fire include, for example, quantification of the area of fire, prospect of movement of fire, direction of movement of fire, speed of movement of fire, prospect of expansion of fire, prospect of splitting of fire and prospect of retraction of fire.

More optionally, the method further comprises communicating the area of fire to an external system. Specifically, the external system refers to a computational element (for example, a mobile phone, a computer, and the like) associated with a person or a bot. More specifically, the area of fire is communicated to the external system to enable a user associated with the external system to take adequate action for the area of fire. Additionally, optionally, the server arrangement does not communicate an insignificant fire detected due to, for example, outdoor grills, burning leaves, burning garbage, and the like. In an example, the area of fire within an observation area is communicated to a user device associated with a resident of the observation area. In another example, the area of fire within an observation area is communicated to a user device of a firefighting organization associated with the observation area.

In an example, the sensor modules provide abnormal sensor data to the server arrangement due to an outdoor grill in the observation area. In such case, the server arrangement processes the sensor data to determine intensity of fire based on level of smoke, increase in temperature, increase in level of heat, increase in air pressure, and the like. Moreover, the server arrangement processes one or more images received from imaging device of the sensor modules to identify an area of fire and/or a source of fire. Subsequently, the server arrangement characterises such fire due to the outdoor grill as insignificant. In another example, the sensor modules provide abnormal sensor data to the server arrangement due to fire from a building in the observation area. In such case, the server arrangement processes the sensor data and one or more images to determine intensity of fire, identify area of fire and identify source of fire. Additionally, the server arrangement determines auxiliary information (such as, direction of movement of fire, speed of movement of fire, prospect of expansion of fire, prospect of splitting of fire and prospect of retraction of fire) associated with the fire in the area of fire. Moreover, the server arrangement characterises such fire from the building as critical. Furthermore, the server arrangement communicates the area of fire, the sensor data and the auxiliary information associated therewith to external systems such as user devices associated with residents of the observation area and/or user devices of firefighting organization associated with the observation area.

Optionally, the server arrangement decreases a time period of receiving sensor data from the sensor module when the server arrangement receives abnormal sensor data from at least one of the sensor modules. More optionally, the server arrangement employs artificial intelligence algorithms to characterize the area of fire and/or to predict the auxiliary information associated with the area of fire.

In one aspect, the present disclosure provides method for estimating progression of a fire, the method comprising receiving first sensor data at a first time instance from at least one sensor module; receiving second sensor data at a second time instance from the at least one sensor module; devising a plurality of first fire scenarios for the first time instance; devising a plurality of second fire scenarios for the second time instance; determining a likelihood of each of the plurality of first fire scenarios matching the first sensor data; determining a likelihood of each of the plurality of second fire scenarios matching the second sensor data; determining a likelihood of fire progression from a given first fire scenario to a given second fire scenario over a time period between the first time instance and the second time instance; determining combined likelihoods of a plurality of combinations of fire scenarios, wherein each combination of fire scenarios comprises a first fire scenario and a second fire scenario and wherein the combined likelihood for a given combination of first fire scenario and second fire scenario is determined based on the likelihood of the first fire scenario in the combination matching the first sensor data, and the likelihood of the second fire scenario in the combination matching the second sensor data, and the likelihood of fire progression from the first fire scenario to the second fire scenario; identifying at least one potential combination of first fire scenario and second fire scenario with a combined likelihood higher than a predefined threshold; estimating progression of the fire and area of the fire based on the at least one potential combination of first fire scenario and second fire scenario.

The present disclosure further provides a system for estimating progression of a fire, the system comprising at least one sensor module arranged in an observation area; a server arrangement communicably coupled to the at least one sensor module. The server arrangement is configured to: receive first sensor data at a first time instance from at least one sensor module; receive second sensor data at a second time instance from the at least one sensor module; devise a plurality of first fire scenarios for the first time instance; devise a plurality of second fire scenarios for the second time instance; determine a likelihood of each of the plurality of first fire scenarios matching the first sensor data; determine a likelihood of each of the plurality of second fire scenarios matching the second sensor data; determine a likelihood of fire progression from a given first fire scenario to a given second fire scenario over a time period between the first time instance and the second time instance; determine combined likelihoods of a plurality of combinations of fire scenarios, wherein each combination of fire scenarios comprises a first fire scenario and a second fire scenario and wherein the combined likelihood for a given combination of first fire scenario and second fire scenario is determined based on the likelihood of the first fire scenario in the combination matching the first sensor data, and the likelihood of the second fire scenario in the combination matching the second sensor data, and the likelihood of fire progression from the first fire scenario to the second fire scenario; identify at least one potential combination of first fire scenario and second fire scenario with a combined likelihood higher than a predefined threshold; estimate progression of the fire and area of the fire based on the at least one potential combination of first fire scenario and second fire scenario.

The method and system for estimating progression of a fire enables timely and efficient fire modelling to achieve accurate and reliable fire prediction results. Notably, the method and system of the present disclosure integrate data from multiple sources to ensure that fire prediction is accurate so that fire responders can make timely decisions, beneficially leading to better firefighting measures, timely evacuations and improved fire responder safety. Furthermore, the system tests a large number of fire scenario, potentially in orders ranging between millions and trillions to identify fire scenarios that match the fire. The system further allows processing to be performed with support of a graphics processing unit that can significantly reduce time required for processing the fire scenarios. Furthermore, the fire prediction model is regularly updated with any change in sensor data, thereby ensuring accurate predictions of characteristics of the fire.

The method and system for estimating progression of the fire enable to estimate the progression of the fire in a determined area of fire. The method comprises receiving first sensor data and second sensor data at a first time instance and second time instance respectively, from the at least one sensor module. Notably, the sensor data from the at least one sensor module is indicative of one or more characteristics (or, parameters) of the fire. Notably, the at least one sensor module is installed in the observation area. It will be appreciated that the presence of the fire is also detected using the sensor data. Notably, the at least one sensor module detects abnormal sensor data (such as, high level of smoke, high temperature, high level of heat, high air pressure, low humidity, high level of organic volatile compound and images depicting flame) to identify the presence of the fire in the observation area.

Optionally, the method comprises pre-processing the sensor data received from the at least one sensor module using machine learning algorithms to determine characteristics of the fire. The server arrangement according of the system of present disclosure is further configured to pre-process the sensor data received from the at least one sensor module using machine learning algorithms to determine the characteristics of the fire. Notably, the sensor data comprises at least one of: information relating to wind, smoke, air pressure, humidity in the observation area; images or videos from an imaging camera, LiDaR data, multispectral and SAR data from the observation area; satellite data relating to the observation area. Therefore, the sensor data is pre-processed using machine learning algorithms, specifically artificial intelligence and neural networks, to determine characteristics of the fire from such sensor data. The machine learning algorithms may employ computer vision and deep learning to extract meaningful insights from the sensor data and determine the characteristics of the fire.

In an example, the server arrangement may extract each frame from a video received from an imaging camera and (a) extract motion vectors or calculate motion vectors based on subsequent frames or (b) process each frame as an image using artificial intelligence for fire detection. The machine learning algorithms enable the server arrangement to become more accurate in predicting outcomes and/or performing tasks, without being explicitly programmed. Specifically, the machine learning algorithms are employed to artificially train the server arrangement so as to enable it to automatically learn and improving performance from experience, without being explicitly programmed.

In another example the server arrangement may be configured to obtain images via image API (e.g. REST API) intended for integration, wherein the server arrangement is configured to acquire the images and process the obtained images using AI for fire detection. The images may be obtained also via image API (such as a proprietary GIS API) wherein, the server arrangement is configured to acquire the images and process obtained images using AI for fire detection. The images may be obtained also via video API (such as RTSP stream, encoded as H.264/H.265 or similar) from a device, from a cloud or cloud front, wherein the server arrangement is configured to acquire a video stream, extract all or parts of frames from the video stream and for each frame i) optionally extract motion vectors either using the video stream codec motion vector information or by calculation motion vectors based on subsequent frames, or ii) process a frame as an image using AI for fire detection. The images may be obtained also via scaping images from third party web services, wherein the server arrangement is configured to emulate an user using a browser to use WEB GUI for browsing the images, and getting the links to the images, downloading the images, and processing the images using AI for fire detection.

Optionally, the server arrangement, employing the machine learning algorithms, for pre-processing the sensor data is trained using a training dataset. Typically, examples of the different types of machine learning algorithms, depending upon the training dataset employed for training the software application comprise, but are not limited to: supervised machine learning algorithms, unsupervised machine learning algorithms, semi-supervised learning algorithms, and reinforcement machine learning algorithms. Furthermore, the processing arrangement is trained by interpreting patterns in the training dataset and adjusting the machine learning algorithms accordingly to get a desired output. Examples of machine learning algorithms employed by the processing arrangement may include, but are not limited to: k-means clustering, k-NN, Dimensionality Reduction, Singular Value Decomposition, Distribution models, Hierarchical clustering, Mixture models, Principal Component Analysis, and autoencoders. The machine learning algorithms may further include image analytics algorithms and representational state transfer APIs (e.g. REST API, GIS API) or video processing API (e.g. RTSP stream).

Optionally, the characteristics of the fire comprise at least one of: duration of the fire, wind speed in an observation area, temperature, humidity, heat index of fire, air quality in the observation area, fuel content, fuel moisture content. It will be appreciated that characteristics of the fire include parameters relating to the fire that may influence a current state of the fire and progression of the fire at a later instance of time. Notably, values of each of the characteristics of the fire are estimated using the sensor data to obtain information relating to the current state of the fire.

Optionally, the server arrangement is communicably coupled to at least one third-party sensor module. Notably, the at least one third-party sensor module provides sensor data for estimation of characteristics of the fire. The at least one third-party sensor module may be maintained by a government authority or privately-owned. Optionally, the sensor data is acquired from a third-party organization. More optionally, the sensor data acquired from the third-party organization is pre-processed using aforementioned techniques.

It will be appreciated that the first sensor data and second sensor data are acquired at the first time instance and second time instance respectively, wherein the first time instance precedes the second time instance. In an example, the second sensor data may provide information relating to the current state of the fire (namely, the second time instance) and the first sensor data may provide information relating to the state of the fire fifteen minutes ago (namely, the first time instance). Notably, comparing the first sensor data and second sensor data provides information relating to a manner in which the fire has progressed in the time period between the first time instance and the second time instance. In an instance, comparing air quality in the observation area may provide information relating to whether the fire has increased or decreased in the time period.

The method comprises devising a plurality of first fire scenarios and a plurality of second fire scenarios for the first time instance and the second time instance respectively. Notably, each of the fire scenarios provide detailed information relating to characteristics of a different, potential fires. It will be appreciated that the fire scenarios, specifically the plurality of first fire scenarios and second fire scenarios, are computer-generated models of different potential states of a fire. Such potential states of the fire are generated by the server arrangement in accordance with proposal distribution techniques known in the art. For example, the proposal distribution techniques employed for sampling the plurality of first fire scenarios and second fire scenarios comprise Metropolis-Hastings algorithm or other Markov chain Monte Carlo algorithms that generate a plurality of fire scenarios for the first and second time instance by taking various characteristics of the fire as an input and generating models of different potential states of a fire as an output. The plurality of first fire scenarios describe different potential states of fire by taking into account characteristics such as fuel, density, type (vegetation, buildings, grass), volume of vegetation, surface area of vegetation, weight of biomass, height of biomass, terrain elevation and slope, local weather such as wind speed, wind direction, gustiness, ambient temperature, moisture of biomass and ground, air humidity, air pressure, characteristics of fire in a location such as temperature, heat generation, flame height, smoke generation, ember generation, type of fire (canopy, buildings, grass and low vegetation), burning fuel: living biomass, dead and dry biomass (e.g. fallen trees, dry grass).

The method comprises determining a likelihood of each of the plurality of first fire scenarios matching the first sensor data and determining a likelihood of each of the plurality of second fire scenarios matching the second sensor data. It will be appreciated that a given fire scenario matching a given sensor data allows estimation and prediction of characteristics of the fire based on the given fire scenario. Notably, the characteristics of the fire determined from the sensor data are compared with the characteristics of the fire scenario to determine the likelihood. The server arrangement employs Hidden Markov Process to model the fire wherein the characteristics of the fire are hidden variables and the sensor data are known variables. Based on the Hidden Markov process, the likelihood (namely, probability) of a given fire scenario occurring with respect to the sensor data is determined. Notably, using characteristics of the fire as hidden variables, likelihood is calculated as the emission probability or the output probability of each of the fire scenarios. Therefore, each of the plurality of first fire scenarios is compared with the first sensor data and each of the plurality of second fire scenarios is compared with the second sensor data to determine the likelihoods.

Specifically, a given first fire scenario having a high likelihood of matching the first sensor data indicates that at first time instance, the characteristics of the fire were similar to the potential fire defined by the given first fire scenario. Similarly, a given second fire scenario having a high likelihood of matching the second sensor data indicates that at a second time instance, the characteristics of the fire are similar to the potential fire defined by the given second fire scenario.

The method comprises determining a likelihood of fire progression from a given first fire scenario to a given second fire scenario over a time period between the first time instance and the second time instance. As mentioned previously, the first time instance precedes the second time instance, wherein the first sensor data and second sensor data are compared to determine the manner in which the fire progressed in the time period between the first time instance and the second time instance. Notably, the likelihood of fire progression provides probability of a combination of fire scenarios occurring for a given potential fire. In other words, the likelihood of fire progression provides a probability of a given first fire scenario developing into a second fire scenario. For example, in an instance the first fire scenario describes a small fire in an observation area with low wind and low fuel content at a first time instance and the second scenario describes a wildfire encompassing several square kilometres of landmass, wherein the time period between the first time instance and the second time instance is thirty minutes. In such instance, the likelihood of fire progressing from the first fire scenario to the second fire scenario may be determined as low or at a low percentage.

Optionally, the first fire scenarios and the second fire scenario with a low value of any of the: likelihood of matching the first sensor data, likelihood of matching the second sensor data, likelihood of fire progression from a given first fire scenario to a given second fire scenario over the time period are excluded from the calculations hereinafter. Notably, such exclusion substantially increases the time required to estimate the progression of the fire.

The method comprises determining combined likelihoods of a plurality of combinations of fire scenarios, wherein each combination of fire scenarios comprises a first fire scenario and a second fire scenario. Notably, the method comprises pairing each of the first fire scenarios with at least one of the plurality of second fire scenarios. It will be appreciated that a given first fire scenario may be paired with a given second fire scenario to form a combination in an instance when the likelihood of fire progression from the given first fire scenario to the given second fire scenario is high. In particular, the first fire scenario and the second fire scenario in each of the plurality of combinations of fire scenarios may at least have a likelihood of fire progression therebetween higher than a given value (for example, 50 percent likelihood). Alternatively, each of the first fire scenarios is paired with each of the second fire scenarios to obtain the plurality of combinations of fire scenarios.

Moreover, the combined likelihood for a given combination of first fire scenario and second fire scenario is determined based on the likelihood of the first fire scenario in the combination matching the first sensor data, and the likelihood of the second fire scenario in the combination matching the second sensor data, and the likelihood of fire progression from the first fire scenario to the second fire scenario.

Notably, in this regard, for each combination, the likelihoods of the first fire scenario, the second fire scenario and the fire progression are combined to determine the combined likelihood. It will be appreciated that contribution of each of the likelihoods towards the combined likelihoods may be weighted and normalized. Furthermore, the combined likelihood of a given combination is indicative of the degree of accuracy to which the first fire scenario and the second fire scenario in the given combination estimate, model and predict the fire.

The method comprises identifying at least one potential combination of first fire scenario and second fire scenario with a combined likelihood higher than a predefined threshold. Herein, the predefined threshold is defined based upon the results of the combined likelihoods of the plurality of combinations of fire scenarios. The predefined threshold may be defined to selectively identify at least one potential combination of fire scenarios from the plurality of combinations of fire scenarios. In an example, the predefined threshold may be 90 percent or 0.9. The at least one potential combination of first fire scenario and second fire scenario most closely identifies the fire being analysed and enables modelling and prediction of progression of the fire. In particular, the first fire scenario in the at least one potential combination may closely match the first sensor data, the second fire scenario in the at least one potential combination may closely match second sensor data and the fire progression from the first fire scenario to the second fire scenario in the at least one potential combination matches the fire progression as exhibited by the comparison between first sensor data and second sensor data.

The method comprises estimating progression of the fire and area of the fire based on the at least one potential combination of first fire scenario and second fire scenario. The at least one potential combination closely resembles the characteristics of the fire in the current state and is used to estimate the area (namely, perimeter of the fire). Furthermore, information provided by the at least one combination can be extrapolated and modelled to predict the progression of the fire. It will be appreciated that at least one potential combination of the first fire scenario and the second fire scenario takes into consideration the future possible conditions relating to the weather, temperature, fuel content and the like to estimate the progression of the fire.

Optionally, the method further comprises devising at least one third fire scenario based on plurality of second fire scenarios and the combined likelihoods of a plurality of combinations of fire scenarios; determining combined likelihoods of a plurality of second combinations of fire scenarios, wherein each second combination of fire scenarios comprises a second fire scenario and a third fire scenario; storing at least one third fire scenario and the combined likelihoods of a plurality of second combinations of fire scenarios; using at least one stored third fire scenario and the combined likelihoods of a plurality of second combinations of fire scenarios to adjust the likelihood of at least one first fire scenario. The said steps of the method can be implemented by the server arrangement of the system according to the present disclosure configured to perform the said steps.

Optionally, in this regard, the at least one third scenario is devised by resampling the posterior distribution defined by the plurality of second fire scenarios and the combined likelihoods of a plurality of combinations of fire scenarios. Alternatively, the at least one third fire scenario is devised by copying the plurality of second fire scenarios and the combined likelihoods into the at least one third fire scenario. It will be appreciated that the resampling, specifically, sampling the posterior distribution, i.e. the combined likelihoods of the second fire scenarios to create the at least one third fire scenario wherein the combined likelihoods of a plurality of second combinations of fire scenarios for example may have equal likelihood or another more balanced likelihood and together may represent the same distribution as the plurality of combination of the fire scenarios. Herein, algorithms employed for resampling may include, but are not limited to, stratified resampling, adaptive resampling, Gaussian approximations to the optimal importance distribution. Notably, in an instance, after determining the combined likelihoods of the plurality of combinations of fire scenarios, 99% of likelihood may be concentrated into one potential combination of first fire scenario and second fire scenario. Therefore, if the combined likelihood of a given second combinations of fire scenario is very low, such likelihood may further reduce likelihood of a corresponding first fire scenario. The at least one third fire scenario and the combined likelihoods of a plurality of second combinations of fire scenarios are stored in a database or memory associated with the server arrangement.

Optionally, the method further comprises receiving a user-input relating to one or more potential characteristics of the fire; and estimating progression of the fire based on the one or more potential characteristics of the fire. Optionally, the server arrangement of the system of estimating progression of the fire is configured to receive a user-input relating to one or more potential characteristics of the fire; and estimate progression of the fire based on the one or more potential characteristics of the fire.

Optionally, in this regard, the one or more potential characteristics of the fire comprise parameters relating to the fire that may affect spread or suppression of the fire. Examples of the potential characteristics include, but are not limited to, fire suppression strategies, fire suppression tactics, fire management strategies, aerial applications of retardant, use of bulldozers, use of fire engines, fire lines, fire breaks, backfire, mopping up. Notably, the user may provide input relating to one or more potential characteristics of the fire to obtain an estimate relating to the manner the progression of the fire may change if one or more potential characteristics of the fire are altered. For example, firefighting personnel may use the at least one potential combination of first fire scenario and second fire scenario to determine the current state and progression estimate of the fire. Subsequently, the one or more potential characteristics may be provided to determine effectiveness of firefighting strategies formulated by the firefighting personnel, on the progression of the fire. In an embodiment, the server arrangement may assume a firefighting strategy, for example employing 40 fire engines, 5 bulldozers, one helicopter, and 1 hour of one tanker plane, prior to receiving any input from the user. Upon receiving the user-input, the progression of the fire may be re-estimated based on the one or more potential characteristics provided by the user. Beneficially, such estimation of fire progression based on the user-input allows real-time estimation of effects of firefighting strategies on the progression of the fire and aids in decision-making related thereto.

In an example the server arrangement is configured to model the fire as a Hidden Markov Process by using for example following variables. According to the present disclosure the Markov Process with locality assumptions (distributions can be calculated in parallel piecewise locally) allowing also GPU support enables to evaluate faster than traditional fire propagation model calculations that take minutes or hours. The evaluation is performed stepwise using for each step the best data available (for example for wind speed). Also the traditional models allow for varying the data. The problems are they take too long to provide iterative planning tool. If an Incident Commander needs to make decision to allocate resources to suppress a fire, he may have just minutes to make the decision. Further, the physical models are approximated with faster learned deep learning based models to predict the likelihoods (for state transitions, and sensor data given model).

Likelihood of a one possible fire state, given new sensor data and sensor data about the previous state of the fire 5, 10, 15, 20, 25, etc. minutes ago.

Likelihood of a one possible fire state, given new sensor data, for example likelihood of fire in a location L1 is high if fire detected in a camera which shows location L1, and is low if a smoke sensor near location L2 does not detect fire.

Likelihood of fire in location L3, given (e.g. a neighbourhood) of the previous fire state, for example, if there was a likely fire in location L4 upwind from location L3 5 minutes ago (and there are no obstacles for fire spread between L3 and L4) if is likely there is not fire in location L4 (as spread from earlier fire location L4), or in case there has not been a fire near location L5 in the previous state, it is not likely there is fire in location L6 which is adjacent to location L5. Such models can be developed for example by deep learning to estimate the transition probability by using for example physical, semi-physical, empirical: including flame contact, solid mass transport (embers in the wind), radiation (heat transfer), convection, internal radiation and convection data.

Scaling term in case some sensor readings (e.g. due to sampling technology) over or underrepresented in the measurement data. Likelihood of previous state according to distributions, i.e. if this new fire state is only likely (or possible) if the previous state required was very unlikely, also this state is unlikely.

The embodiments according to the present disclosure enable to help Incident Commanders quickly to evaluate different tactics and strategies to see a predicted fire behaviour as the decision may be needed in minutes, and in all cases in hours. In practice, the agency or resource data is always lagging (and cannot be reliably integrated with other systems, except for post fact documentation), hence the present disclosure provides the user the capability simply to list the resources they want to use for planning (by resource type).

These advantages of the method and system for determining area of fire and estimating the progression of fire can be achieved according to the present disclosure by testing many potential fire scenarios (each scenario defines, where and what kind of fire characteristics such as temperature, heat generation, wind, etc.); by testing how well a fire scenario fits with the sensor data concerning the area of the fire.

For example, by calculating conditional probability of fire characteristics at location (latitude, longitude) given sensor data to detect the fire in the given location. If a camera looks at the location of the fire, and a fire is detected in the camera image, the likelihood of fire in the location at the time of the sensor data (image) is high, and if no fire is detected, the likelihood is low; same goes for smoke sensors etc. Selecting one or more fire scenarios which define the estimated fire properties (and perimeter) as the estimate of the fire based on sensor data.

In addition, testing how well fire scenarios will fit with the probable (a set of scenarios, or a probability distribution of scenarios) fire at an earlier point of time. For example, calculating conditional probability of fire characteristics at location (latitude, longitude) given probability of fire characteristics earlier in or in connection with the given location. If the neighbouring acre was estimated to be burning 15 minutes ago, and the location is downwind from the neighbouring acre, the likelihood of the location burning based on earlier state is high, and if there was no fire earlier, the likelihood of the fire based on earlier state is low (as that would be a new ignition, which is possible, but not likely)

The fire propagation models according to the present disclosure include 1) a set of prior data distribution in locations: fuel, density, type (vegetation, buildings, grass), volume of vegetation, surface area of vegetation, weight of biomass, height of biomass, terrain elevation and slope, local weather such as wind speed, wind direction, gustiness, ambient temperature, moisture of biomass and ground, air humidity, air pressure; 2) characteristics of fire in a location such as temperature, heat generation, flame height, smoke generation, ember generation, type of fire (canopy, buildings, grass and low vegetation), burning fuel: living biomass, dead and dry biomass (fallen trees, dry grass), etc.

Evaluating the fit of a fire scenario both to sensor data, and to previous state of the model of fire, allows integrating previous sensor data (a fire ignition was seen in a location) to the current estimate of the model (where all sensor data is used, and projected in time using the transmission models (i.e. fire propagation models). For example, smoke particles may move at the speed of the wind. If we detect smoke particles in a location, the potential sources for the smoke particles may be 1 minute away, or 5 hours away, depending on how long they have been traveling before reaching the sensor. Therefore, it is mandatory to integrate all sensor data (over several hours or even days into a single model to be able to determine the actual source of the detections).

In some embodiments the number of variants to be tested may be for example 1 million, or 1 trillion. The calculations may run in one or multiple CPU, or in GPUs. A GPU cluster can shorten the time for the processing. Calculations may be in a device, a vehicle, laptop, computer, or in the cloud. Model can be all-the-time updated (progressed at time steps, and/or whenever new sensor data is available).

DETAILED DESCRIPTION OF THE DRAWINGS

Referring to FIG. 1 illustrated are steps of a method 100 for determining an area of fire, in accordance with an embodiment of the present disclosure. At a step 102, a first sensor module, a second sensor module and a third sensor module are arranged on an observation area at different locations from each other. At a step 104, sensor data is received from each of the sensor modules. At a step 106, relative location of each of the sensor modules with each other is determined in respect to wind. At a step 108, area of fire is determined to be within an area defined by the locations of the sensor modules if the first sensor module detects fire while the second sensor module and the third sensor module do not detect fire, and the second sensor module and the third sensor module are windward from the first sensor module.

Figure 2:
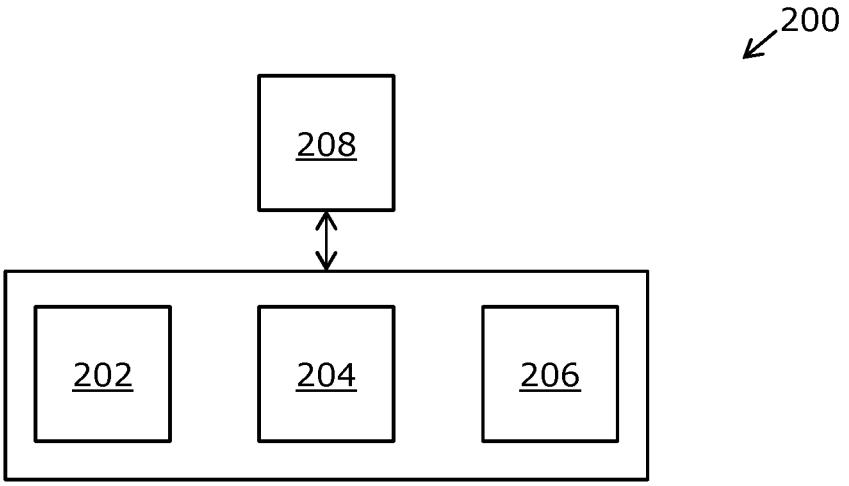
FIG. 2 is a block diagram of a system for determining an area of fire, in accordance with an embodiment of the present disclosure.

Referring to FIG. 2 illustrated is a block diagram of a system 200 for determining an area of fire, in accordance with an embodiment of the present disclosure. As shown, the system 200 comprises sensor modules (depicted as first sensor module 202, second sensor module 204, and third sensor 206). Moreover, the system 200 comprises a server arrangement 208 communicably coupled to the sensor modules 202, 204, 206.

Figure 3:
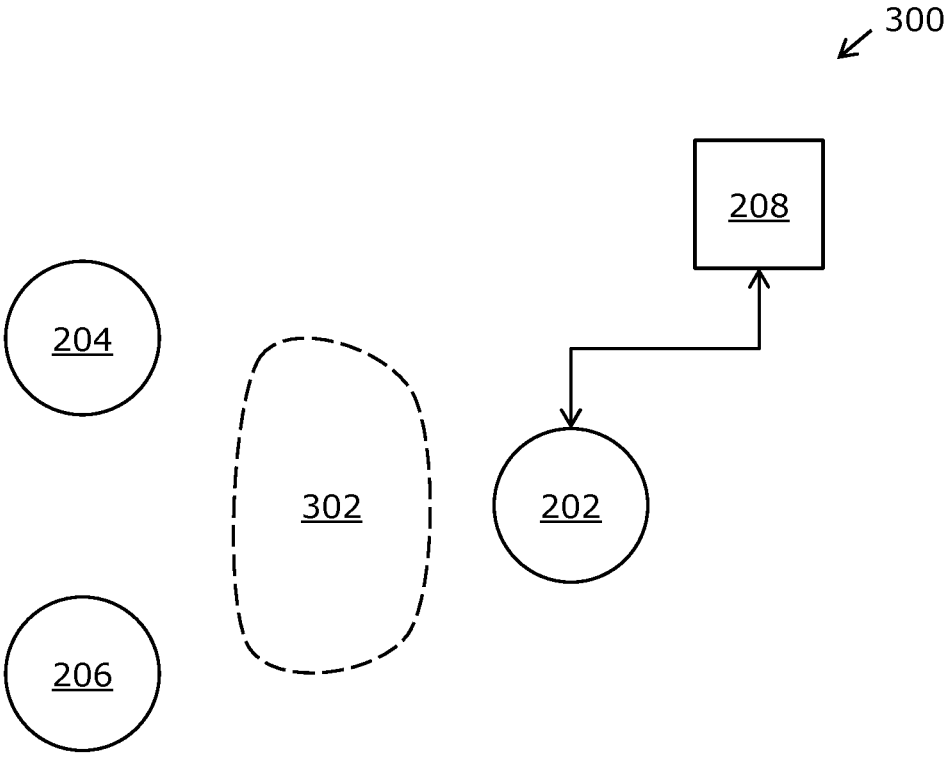
FIG. 3 is a schematic illustration of implementation of a system for determining an area of fire, in accordance with an embodiment of the present disclosure.

Referring to FIG. 3 illustrated is a schematic illustration of a system 300 for determining an area of fire 302, in accordance with an embodiment of the present disclosure.

As shown, the system 300 comprises sensor modules (depicted as first sensor module 202, second sensor module 204, and third sensor 206) that are arranged at different locations from each other. Moreover, the system 300 comprises the server arrangement 208. It will be appreciated that the server arrangement 208 is communicably coupled to each of the sensor modules 202, 204, 206. The server arrangement 208 receives sensor data from the sensor modules 202, 204, 206. The server arrangement 208 determines the area of fire 302 to be within an area defined by the locations of the sensor modules 202, 204, 206 if the first sensor module 202 detects fire while the second sensor module 204 and the third sensor module 206 do not detect fire and the second sensor module 204 and the third sensor module 206 are windward from the first sensor module 202.

Figure 4:
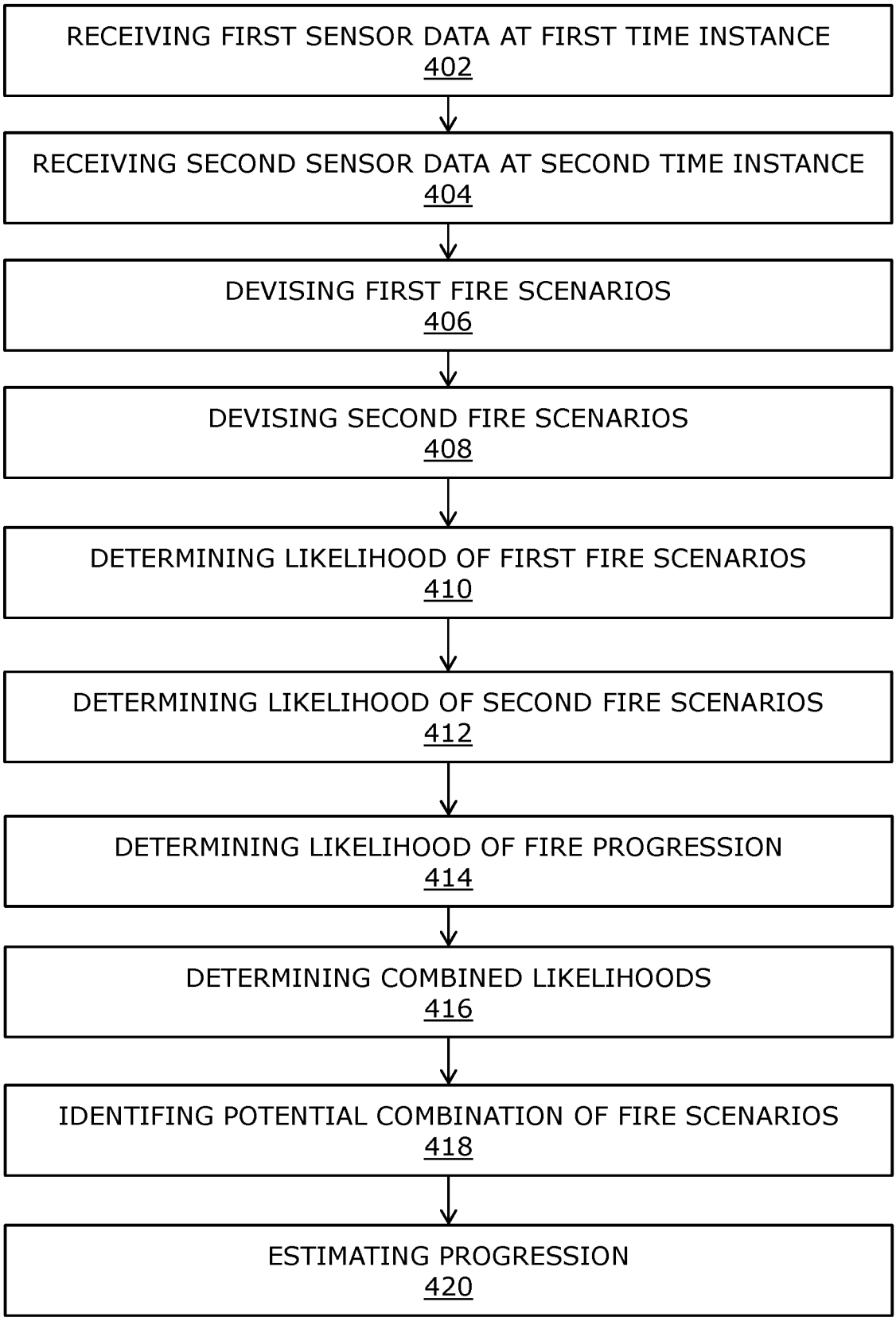
FIG. 4 is a flowchart depicting steps of a method for estimating progression of a fire, in accordance with an embodiment of the present disclosure.

Referring to FIG. 4A, illustrated is a flowchart depicting steps of a method for estimating progression of a fire, in accordance with an embodiment of the present disclosure. At step 402, first sensor data at a first time instance is received from at least one sensor module. At step 404, second sensor data at a second time instance is received from the at least one sensor module. At step 406, a plurality of first fire scenarios are devised for the first time instance. At step 408, a plurality of second fire scenarios are devised for the second time instance. At step 410, a likelihood of each of the plurality of first fire scenarios matching the first sensor data is determined. At step 412, a likelihood of each of the plurality of second fire scenarios matching the second sensor data is determined. At step 414, a likelihood of fire progression from a given first fire scenario to a given second fire scenario over a time period between the first time instance and the second time instance is determined. At step 416, combined likelihoods of a plurality of combinations of fire scenarios are determined. Notably, each combination of fire scenarios comprises a first fire scenario and a second fire scenario. Furthermore, the combined likelihood for a given combination of first fire scenario and second fire scenario is determined based on the likelihood of the first fire scenario in the combination matching the first sensor data, the likelihood of the second fire scenario in the combination matching the second sensor data, and the likelihood of fire progression from the first fire scenario to the second fire scenario. At step 418, at least one potential combination of first fire scenario and second fire scenario with a combined likelihood higher than a predefined threshold is identified. At step 420, progression of the fire and area of the fire are estimated based on the at least one potential combination of first fire scenario and second fire scenario.

Figure 5:
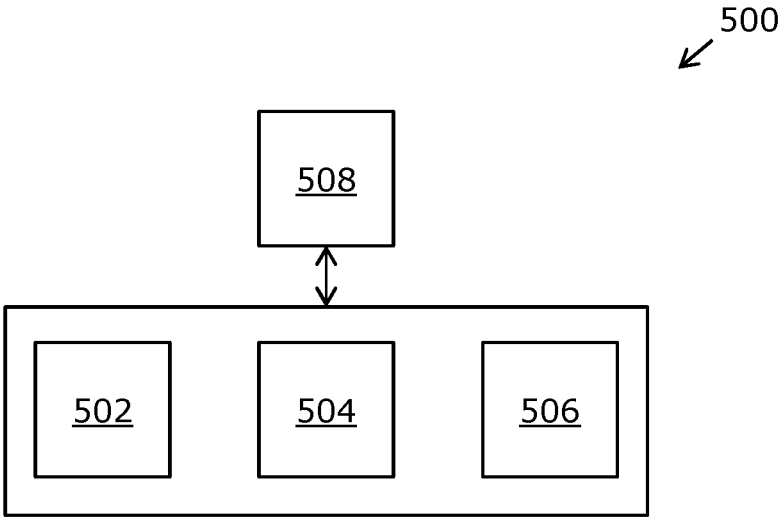
FIG. 5 is a block diagram illustrating a system for estimating progression of a fire, in accordance with an embodiment of the present disclosure.

Referring to FIG. 5, there is shown a block diagram illustrating a system 500 for estimating progression of a fire, in accordance with an embodiment of the present disclosure. The system comprises a first sensor module 502, a second sensor module 504 and a third sensor module 506 arranged in an observation area and a server arrangement 508 communicably coupled to the sensor modules 502, 504, 506.

The server arrangement 508 is configured to receive first sensor data at a first time instance from at least one sensor module of the sensor modules 502, 504, 506; receive second sensor data at a second time instance from the at least one sensor module of the sensor modules 502, 504, 506; devise a plurality of first fire scenarios for the first time instance; devise a plurality of second fire scenarios for the second time instance; determine a likelihood of each of the plurality of first fire scenarios matching the first sensor data; determine a likelihood of each of the plurality of second fire scenarios matching the second sensor data; determine a likelihood of fire progression from a given first fire scenario to a given second fire scenario over a time period between the first time instance and the second time instance; determine combined likelihoods of a plurality of combinations of fire scenarios. Notably, each combination of fire scenarios comprises a first fire scenario and a second fire scenario. Furthermore, the combined likelihood for a given combination of first fire scenario and second fire scenario is determined based on the likelihood of the first fire scenario in the combination matching the first sensor data, the likelihood of the second fire scenario in the combination matching the second sensor data, and the likelihood of fire progression from the first fire scenario to the second fire scenario. The server arrangement 508 is configured to identify at least one potential combination of first fire scenario and second fire scenario with a combined likelihood higher than a predefined threshold; and estimate progression of the fire and area of the fire based on the at least one potential combination of first fire scenario and second fire scenario.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A method for determining an area of fire, the method comprising:

arranging a first sensor module, a second sensor module and a third sensor module on an observation area at different locations from each other;

receiving sensor data from each of the sensor modules;

determining relative location of each of the sensor modules with each other in respect to wind; and determining the area of fire to be within an area defined by the locations of the sensor modules if:

the first sensor module detects fire while the second sensor module and the third sensor module do not detect fire; and the second sensor module and the third sensor module are windward from the first sensor module.

2. A method according to claim 1, wherein the method further comprises characterizing the area of fire, wherein the characterization is based on an intensity of fire in the determined area of fire.

3. A method according to claim 1, wherein the method further comprises communicating the area of fire to an external system.

4. A system for determining an area of fire, the system comprising:

a first sensor module, a second sensor module, and a third sensor module arranged on an observation area, wherein the sensor modules are arranged at different locations from each other; and a server arrangement communicably coupled to the sensor modules, wherein the server arrangement:

receives sensor data from each of the sensor modules;

determines relative location of each of the sensor modules with each other in respect to wind; and determines the area of fire to be within an area defined by the locations of the sensor modules if:

the first sensor module detects fire while the second sensor module and the third sensor module do not detect fire; and the second sensor module and the third sensor module are windward from the first sensor module.

5. The system according to claim 4, wherein the sensor module comprises at least one of: a fire detection sensor, a location sensor, a wind sensor, a communication means, an imaging device, a detection sensor.

* * * * *